United States Patent [19]

LaPointe, deceased

[11] Patent Number: 4,723,718

[45] Date of Patent: Feb. 9, 1988

[54] CHIP CRUSHING SURFACES

[75] Inventor: Joseph A. LaPointe, deceased, late of Pointe Claire, Canada, by June LaPointe, executrix

[73] Assignee: Domtar Inc., Montreal, Canada

[21] Appl. No.: 360,826

[22] Filed: Mar. 23, 1982

[51] Int. Cl.[4] ..... B30B 3/02

[52] U.S. Cl. ..... 241/235; 241/114; 241/117; 241/252; 241/260

[58] Field of Search ..... 241/110–121, 241/235, 250, 251, 252, 253, 257 R, 260, 261.3, 278, 298

[56] References Cited

U.S. PATENT DOCUMENTS

| | | | |
|---|---|---|---|
| 58,977 | 10/1866 | Benoit | 241/235 |
| 1,183,573 | 5/1916 | LePage | 241/235 X |
| 1,183,574 | 5/1916 | LePage | 241/235 |
| 3,962,966 | 6/1976 | LaPointe | 241/117 X |

FOREIGN PATENT DOCUMENTS 825416 10/1969 Canada .

*Primary Examiner*—Timothy V. Eley

[57] ABSTRACT

The cooperating surfaces defining a pressing nip in a chip crusher are formed with specific patterns to treat the chips by fissuring to facilitate penetration by cooking chemical for the making of pulp for papermaking and the like. One of the surfaces is provided with a plurality of land areas separated by valleys, the land areas being substantially continuous and extending in the direction of movement of the surface as it passes through the crushing nip. The surface cooperates with the surface of a roll which defines the other side of the nip, the roll surface is provided with a plurality of teeth with the crown of each tooth defining a line preferably extending substantially perpendicular to the direction of movement of the roll surface through the nip.

8 Claims, 6 Drawing Figures

CHIP CRUSHING SURFACES

FIELD OF THE INVENTION

The present invention relates to a chip crushing device more particularly the present invention relates to surface designs for cooperating working surfaces adapted to squeeze wood chips there between and modify the structure of the chip to make it more uniformly receptive to impregnating chemicals.

BACKGROUND TO THE INVENTION

In the manufacture of pulp and paper wood is usually chipped into wood particles using a chipper. Many types of chippers available, however the conventional chipper cuts across the wood at an angle to the grain to define the length of the chip and the thickness is determined by splitting along the grain. Therefore, despite the fact that major investigations have been made on cutting angles of the knives etc., the thickness of the chips produced by such conventional chippers is not accurately controlled.

Wafer chippers have also been used to produce chips for pulping, such chippers or waferizers as they are sometimes called cut generally along (parallel to) and across the grain with the main cutting edge parallel to the grain to produce chips that have a uniform thickness and therefore a more uniform impregnation characteristic. However, the benefits derived from wafer chips can only be obtained if only wafer chips are used to charge the digester. However, since it is normal practice to purchase chips from a variety of different suppliers and not all suppliers have the same type of wafer chipper the uniformity in thickness obviously is not obtained and therefore neither would the benefits. Furthermore the wafer chipper is much more expensive to maintain since it generally requires the use of a plurality of discrete knives, each of which cuts a single chip.

It has been proposed to treat chips produced by a conventional chipper to render them more uniformly impregatable for example by shredding of conventional chips to reduce them to smaller particles which may be more quickly and more uniformly impregnated, however, such shredding generally increases the number of fines which cause problems during digestion that to a degree defeat the purpose of the shredding operation.

It is also proposed to crush chips using a chip crusher such as the crusher shown in Canadian patent No. 825,416 issued Oct. 29, 1969 to Kutchers et al which utilizes a pair of rolls to crush the chips and fissure them to render them more easily and more uniformly penetrable by cooking liquor in the pulping process.

In the said Kutchera et al patent a specific surface design is proposed wherein each of the rolls are provided with ribs spaced 0.375 to 0.91 inch and have uniform heights between about 0.007 and 0.13 inch, and surfaces or land areas of 0.12 inch to 0.2 inch with the rib height ratio of the two rolls never exceeding about 4 to 1.

The device of the Kutchera et al patent has been tried but it is believed it is no longer in operation, part of the problem being the limited capacity of the equipment.

U.S. Pat. No. 3,962,966 issued June 15, 1976 to Lapointe describes an improved arrangement for increasing the throughput through the crusher. In this device the chips are fed axially onto a rotating disc which flings them out radially in a substantially one chip thickness layer, that passes between a roll and a working surface of the disc to squeeze chips of greater than a certain thickness.

BRIEF DESCRIPTION OF THE INVENTION

It is an object of the present invention to provide a new surface design of the working surfaces of a crusher such as those shown in the said Canadian patent of Kutchera et al or in the Lapointe type crusher shown in U.S. Pat. No. 3,962,966.

Broadly the present invention relates to a chip crusher composed of a pair of co-operating surfaces defining a pressing nip, said surfaces being mounted to move in substantially the same direction through said nip, one of said surfaces being provided with a plurality of land areas separated by valleys, said land areas being substantially continuous and extending substantially in said direction of movement as said one surface passes through said nip, each of said land areas being between about 0.1 to 0.04 inch in width in the direction perpendicular to said direction of movement and being spaced centre to centre of said land areas by 0.2 to 0.6 inch said valley having a depth of at least 0.03 inch and having sloping side walls extending no greater than 160° and preferrably between 135° and 160° to said land areas, the other of said surfaces forming the periphery of a roll being provided with a plurality of teeth with the crown of each said looth defining a line preferably extending substantially perpendicular to said direction of movement through said nip and having a tooth depth of between about 0.05 inch and 0.1 inch and having their crowns spaced between about 0.1 and 0.6 inch.

BRIEF DESCRIPTION OF THE DRAWINGS

Further features, objects and advantages will be evident in the following detailed description of the preferred embodiments of the present invention taken in conjunction with the accompanying drawings in which.

DESCRIPTION OF THE PREFERRED EMBODIMENTS

Figure 1:
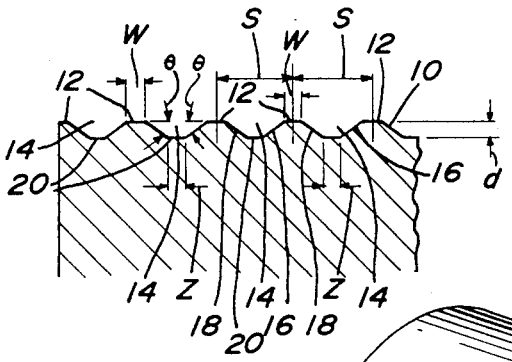
FIG. 1 is a section through a plate or roll illustrating the surface configuration of one of the surfaces.
Figure 2:
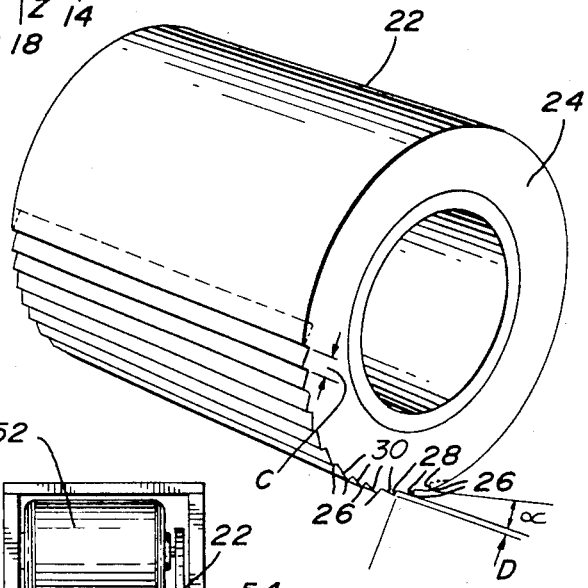
FIG. 2 is an end view of a roll incorporating the co-operating or mating surface.

The configurations of the two mating surfaces are depicted in FIGS. 1 and 2.

The surface 10 of FIG. 1 is composed of a plurality of spaced land areas designated at 12. Each being positioned in the same plane and having a width W and spaced from the adjacent land areas 12 by a distance centre to centre as indicated at S. The valleys 14 between each of the land areas 12 are formed by a pair of sloping sidewalls 16 and 18 extending between the surfaces or land areas 12 and the planer bottom sections 20 of the valleys. The sections 20 are substantially parallel to the areas 12. These sidewalls 16 and 18 extend at an angle $\theta$ to the sections 20 at the bottom of the valleys 14 and thus to the land areas 12. The sections 20 each have a width generally indicated at Z in FIG. 1.

Figure 4:
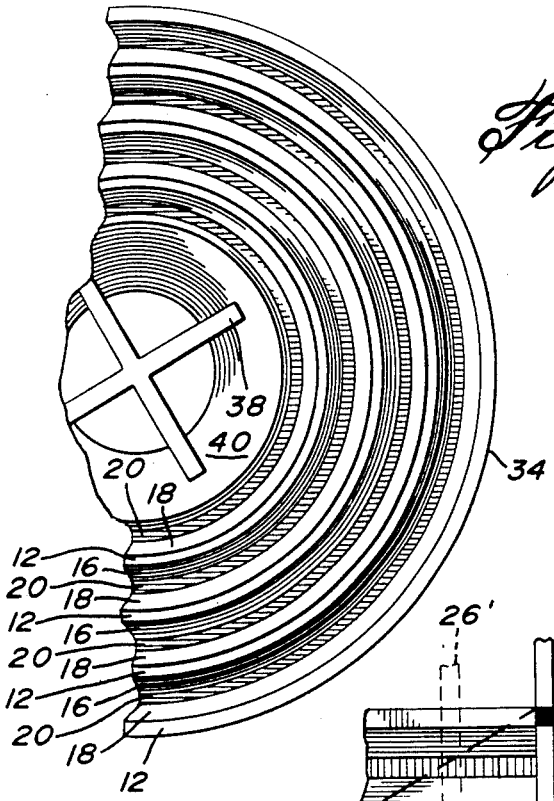
FIG. 4 is a plan view of the two discs used in the embodiment of FIG. 3.

The land areas 12 and thus the valley 14 there between extend generally in the direction of relative movement between the surface 10 and the co-operating surface 22 shown in FIG. 2. If the surface 10 is incorporated on the disc as shown in FIG. 4 the land areas 12 form concentric rings spaced by the valleys 14 or if the surface 10 is provided on a roll such as that indicated schematically in FIG. 5 the land areas 12 will extend circumferentially on the roll and form a plurality of spaced ring pressure members each on substantially the same radius extending circumferentially around the roll as right circular rings.

It has been found by experiment that the width of the land areas 12 as indicated by the letter W must be within certain limits as must the spacing S between the land areas 12 if proper fissuring of the chips is to be obtained. These dimensions may vary depending on the thickness and or length of the chip to be treated using the device however they will generally lie within the following ranges W=0.1 to 0.04 inch, S=0.2 to 0.6 inch and $\theta$ should never be less than about 20°, i.e. the angle between the land area and the side wall should not exceed 160°, it being important that the depth d i.e. the total depth of the valleys between the land areas 12 and the bottom surfaces 14 be at least 0.03 inch, obviously the dimension Z will depend on the angle $\theta$ spacing S and width W as well as the depth d for any given configuration. The spacing S should be such that the nominal chip length to be treated will substantially always contact at least two land areas.

The mating surface 22 adapted to cooperate with the surface 10 is provided on a roll such as the roll indicated at 24 in FIG. 2 since at least one of the surfaces 22 or 10 will be the surface of a roll to form a nip. The peripheral surface 22 of the roll 24 is formed by plurality of uniformly spaced teeth having their apex ends or crowns 26 extending in lines substantially longitudinal of the axis of rotation of the roll (see FIGS. 2 and 3). Each of these teeth has its crown 26 formed by the extention of a front face 28 and a trailing face 30 which form a saw tooth like configuration. These faces 28 and 30 preferably meet at 90° generally between about 60° and 120° and the faces 30 will preferably be at an angle $\alpha$ to a tangent to the surface of the roll 24. The angle $\alpha$ will be between about 5 and 45 degrees, preferably about 15°. The circumferencial spacing C between a pair of adjacent crowns 26 will generally be about equal about 0.1 to 0.6 inch so that 2 teeth will normally engage a chip and the depth of these teeth i.e. the height of the walls 28 as indicated by D will be at least 0.03 inch and generally will not exceed 0.1 inch.

Figure 3:
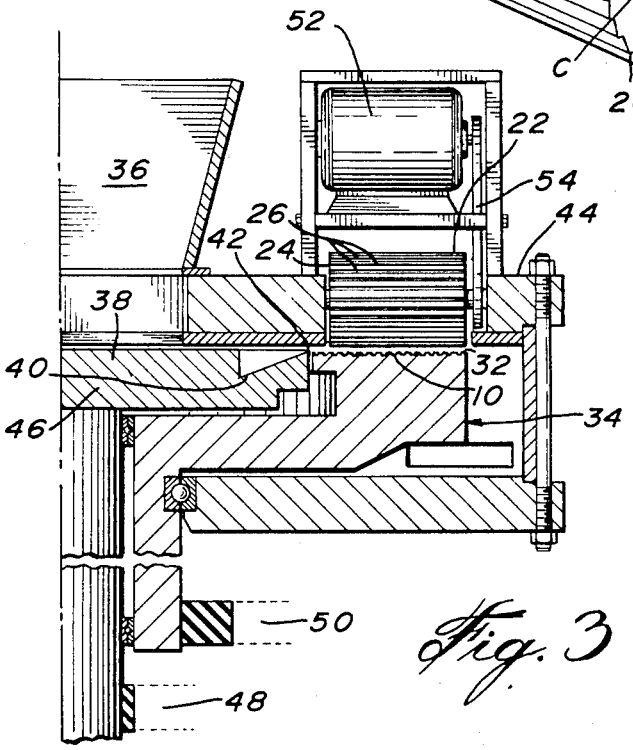
FIG. 3 is a cross section of the preferred embodiment of a device employing the mating crushing surfaces of the present invention.

The radius of the roll 24 i.e. of the crowns 26 of the teeth determines the angle of attack of the teeth to the chip thus when the roll diameter changes it may be desirable to modify the size and shape of the teeth. The diameter of the roll should be chosen to ensure the chips will be drawn into the nips by the action of the two surfaces 10 and 22. The diameter of the roll for use in a roll and disc combination as illustrated in FIGS. 3 and 4 should be between about 3 and 12 inches preferably between 5 and 8 inches. The height of gap or clearence G (see FIG. 5) of the nip for either the disc and roll combination or the pair of rolls embodiments will depend on the maximum tickness chip to be fed to the nip and the thickness of the treated chips or spacing between fissures in the treated chips. Generally the nips will have gaps G of 0.04 to 0.1 inch. In one design a roll having a diameter of about 5 $\frac{3}{4}$ inches, with the angle $\alpha$=15°, depth D=0.06 inch and the spacing C=0.4 inch, the height or gap G was set at 0.06 inch for treating chips having a maximum thickness of slightly over 0.25 inch using a disc with W=0.06 inch, S=0.3 inch, Z=0.06 inch and d=0.055.

As above indicated mating surfaces extend such that the ridges or crowns 26 are substantially perpendicular to the longitudinal axis of the land areas 12 in the nip formed between the surfaces 10 and 22.

In the embodiment illustrated in FIG. 3 and 4 the roll 24 is mounted on a fixed housing in a device somewhat similar to that described in the above referred to Lapointe patent. The chips enter each nip 32 formed between the surface 10 on the rotating disc 34 and the surface 22 on the mating rotating roll 24. The disc 34 as illustrated in FIG. 4 is provided with the spaced land areas 12 in the form of concentric rings extending around the axis of rotation of the disc 34 as shown for example in FIG. 4 with the valleys 14 as formed by the walls 16, 18 and the bottom wall 20 there between.

The preferred crusher arrangement uses the disc 34 and roll 24 in combination similar to that disclosed in the said Lapointe U.S. Pat. No. 3,962,966 modified to use the orienting mechanism described in copending Lapointe application 360,827 filed March 23, 1982. The chips enter through the inlet 36 and are flung by flingers or orienting bars 38 up an inclined orienting surface 40 wherein the chips are laid on their larger area face and the oversized material acted on to reduce it to a certain predetermined thickness to pass out through the outlet passage 42 formed by a pair of substantially parallel walls one on the disc 46 and the other on the housing 44, for further details see the said copending Lapointe application. Chips that pass through outlet 42 are flung from the disc 46 onto the disc 34 for movement through the nip 32 between the disc 34 and the roll 24. A plurality of rolls 24 will be spaced around the circumference of the disc 34 to provide a plurality of spaced apart nips 32 through which chips may pass. The disc 46 preferably is driven by a drive belt 48 at a speed higher than the speed of rotation of the disc 34 which is driven via a belt 50 i.e. the angular velocity of the disc 46 is higher than that of the annular ring formed by the disc 34. The rolls 24 may also be driven via a suitable motor such as that indicated at 52 through suitable belt drives such as that schematically illustrated at 54 in FIG. 3. The roll surface 22 preferably will travel at about the same speed and in substantially the same direction as the surface of the disc through the nip 32. (Obviously the surface 22 of roll 24 at any one time has the same tangential velocity in the direction of movement through the nip while the tangential velocity of the disc varies with the radius and thus provision must be made for the drive for the roll 24 to permit some slippage. Usually the surface 22 will be driven by drive 52 at a velocity substantially equal to the velocity of the surface 10 at the mid point of the nip and obviously if the roll 24 is driven by the surface 10 through a chip the velocity of the roll will vary depending on the radial location of the chip relative to the surface 10.

The surface of the disc 46 preferably will be slightly lower than the wall of the outlet 42 formed by the disc 46 so that the chips pass from the disc 46 and at least part way across the surface 10 in free flight.

Figure 5:
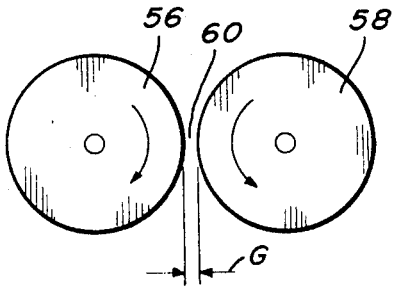
FIG. 5 is an alternative embodiment incorporating the present invention in a chip crusher of the type described in the said Kutchera et al patent.

If desired the present invention may also be applied to a pair of mating compression rolls such as those indicated at 56 and 58 in FIG. 5, the roll 56 may be provided with a working surface equivalent to the surface 10 as illustrated in FIG. 1 and the roll 58 with a surface configuration such as the surface configuration 22 used on the roll 24. In any event the nip 60 formed between these rolls will function in a manner quite similar to the nip 32 formed between the roll 24 and the annular disc 34. However, the radius of the two rolls may be larger than 12 inches for this embodiment provided the approach angle between the two rolls will accept the chips to be fed thereto.

Figure 6:
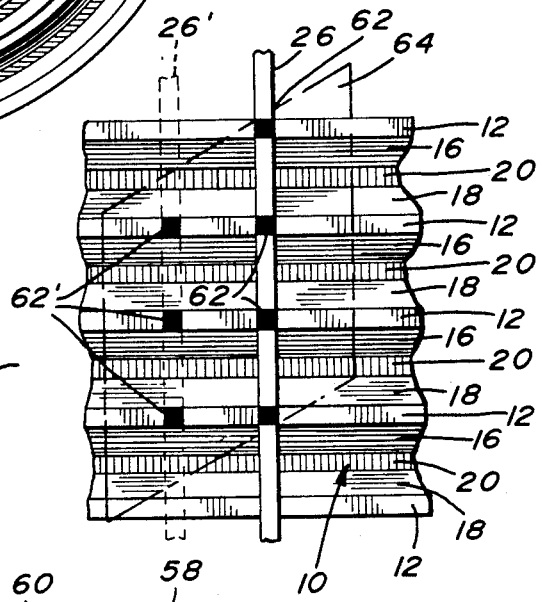
FIG. 6 is a plan view schematically illustrating the pressure pattern applied to a chip passing through a nip formed between a pair of surfaces incorporating the present invention.

In any embodiment employing the present invention the concept is to have a pressure applied to the chips at spaced locations longitudinally and transversly of the chips. These spaced locations as indicated by the blackened areas 62 are formed where the land area mates with the apexes 26 of the teeth on the roll 24 as shown in FIG. 6 as the apex 26 of one of the teeth comes down and approaches the surface 10 of say the disc 34, pressure points are developed between the land areas 12 and the adjacent points or crowns 26. The first tooth 26 shown in FIG. 6 provides a first line of areas 62 extending across the chip generally indicated at 64 by a dot dash line, press the chip between the surfaces 10 and 22 at points 62, this pressing tends to force the chip into the valleys between the land areas 12 and thereby deflect the chip beyond the elastic limit while simultanously compressing the chip (depending on the chip thickness) so that internal cracking and fissuring occurs either longitudinally of the chip or transversly of the chip depending on the orientation of the chip relative to the teeth 26 and to the land areas 12 but substantially always along fibre boundries. These pressure points 62 are repeated further along the chip 64 as indicated by the areas 62' as defined by the second tooth 26' the spacing between the pressure points 62 and 62' being determined by the spacing between the tips 26 of the teeth and the rate of rotation of the surface 22 relative to the movement of the chip 64. Obviously the illustration is schematic and the pressure points 62 will take place in the same vertical plane as the pressure points 62' in spaced locations along the surfaces 10 and 22.

In operation the surfaces 10 and 22 cooperate in the nip to apply forces as above described to compress thick chips with localized spaced high pressure points or with thinner chips to apply local spaced compression points without substantially densifying the surface at the chip to resist impregnation yet with sufficient force to fissure and crack oversize chips to render them more easily impregnated and facilitate more uniform impregnation of the chips.

Having described the invention, modifications will be evident to those skilled in the art without departing from the spirit of the invention as defined in the appended claims.

We claim:

1. A chip crusher composed of a pair of cooperating surfaces defining a pressing nip, said surfaces being mounted to move in substantially the same direction through said nip, one of said surfaces being provided with a plurality of land areas separated by valleys, said land areas being substantially continuous and extending substantially in the direction of movement as said one surface passes through said nip, each of said land areas being between about 0.1 and 0.04 inch in width in a direction substantially perpendicular to said direction of movement and being spaced centre to centre of said land areas by 0.2 to 0.6 inch, said valleys having a depth of at least 0.03 inch and having sloping sidewalls extending at no greater than an angle of 160° to said land areas, the other of said surfaces forming the periphery of a roll and being provided with a plurality of teeth with the crowns of each of said teeth defining a line extending substantially perpendicular to the direction of movement through said nip and having a tooth depth of between 0.03 inch and 0.1 inch and having their crowns spaced between 0.1 and 2 inches.

2. A chip crusher as defined in claim 1 wherein the crowns are defined by a trailing surface and a leading surface which meet at about 60° to 120°.

3. A chip crusher as defined in claim 2 wherein said trailing surface extends at an angle of between 10 and 20 degrees to the tangent of said roll.

4. A chip crusher as defined in claim 1 wherein said valleys are formed by a bottom surface and a pair of sloping sidewalls extending at an angle of between 135° and 160° to said land areas.

5. A chip crusher as defined in claim 1 wherein said one surface is provided on an annular surface rotated about an axis of rotation.

6. A chip crusher as defined in claim 5 further comprising a plurality of said other surfaces spaced about said axis of rotation to provide a plurality of nips between said one surface and said other surfaces.

7. A chip crusher as defined in claim 6 further comprising a disc mounted within said annular member means for orienting chips on said disc and for passing only chips having a thickness less than a preset thickness from said disc onto said annular surface.

8. A chip crusher as defined in claim 7 wherein an outlet from said disc for discharging chips onto said annular surface is higher than said annular surface so that chips passing from said outlet may travel in free flight at least part way across said annular surface.

* * * * *